US008826704B1

(12) United States Patent
Marshall

(10) Patent No.: US 8,826,704 B1
(45) Date of Patent: Sep. 9, 2014

(54) RAPID-ACCESS WEAPON SAFE

(71) Applicant: Ralph Marshall, Moore, OK (US)

(72) Inventor: Ralph Marshall, Moore, OK (US)

( * ) Notice: Subject to any disclaimer, the term of this patent is extended or adjusted under 35 U.S.C. 154(b) by 0 days.

(21) Appl. No.: 13/963,568

(22) Filed: Aug. 9, 2013

(51) Int. Cl.
*E05B 65/52* (2006.01)
*E05G 1/10* (2006.01)
*E05G 1/02* (2006.01)

(52) U.S. Cl.
CPC .. *E05G 1/10* (2013.01); *E05G 1/02* (2013.01); *Y10S 70/65* (2013.01); *Y10S 224/912* (2013.01)
USPC ..... 70/63; 70/161; 70/DIG. 65; 5/308; 5/503.1; 5/658; 109/50; 109/59 R; 109/59 T; 109/67; 206/317; 211/64; 220/210; 220/826; 224/912; 248/553; 312/290

(58) Field of Classification Search
USPC ..... 70/63, 158–162, DIG. 65; 109/67, 68, 109/64, 66, 50–52, 59 R, 59 T, 74, 75; 211/64; 248/551–553; 224/912, 913; 220/480, 481, 651, 210, 826, 830; 206/317; 312/245, 319.2, 324, 290; 42/70.11; 5/308, 658, 503.1; 292/DIG. 21
See application file for complete search history.

(56) References Cited

U.S. PATENT DOCUMENTS 2,706,036 A * 4/1955 Neal ..... 206/317
3,307,755 A * 3/1967 Lentz ..... 206/317
3,378,323 A * 4/1968 Goldberg ..... 312/270.1
3,797,643 A * 3/1974 Shupp ..... 294/165
4,309,065 A * 1/1982 Pappas ..... 312/242
4,785,971 A * 11/1988 Konarik ..... 221/312 R
4,788,838 A * 12/1988 Cislo ..... 70/63
4,826,115 A * 5/1989 Novitski ..... 248/224.8
4,832,193 A * 5/1989 Kime ..... 206/372
4,869,449 A * 9/1989 Goodman ..... 248/205.1
4,896,070 A * 1/1990 Reid et al. ..... 312/290
4,936,454 A * 6/1990 Wang ..... 206/425
4,998,424 A * 3/1991 Lambert, II ..... 70/63
5,009,088 A * 4/1991 Cislo ..... 70/63
5,056,342 A * 10/1991 Prinz ..... 70/63
5,111,755 A * 5/1992 Rouse ..... 109/25
5,168,994 A * 12/1992 Beletsky et al. ..... 206/317
5,484,092 A * 1/1996 Cheney ..... 224/404
5,611,226 A * 3/1997 Fata ..... 70/454
5,662,219 A * 9/1997 Tschudy et al. ..... 206/317
5,769,260 A * 6/1998 Killinger et al. ..... 220/533
6,405,861 B1 * 6/2002 Siler et al. ..... 206/317
6,568,230 B1 * 5/2003 Chen ..... 70/419
6,570,501 B2 * 5/2003 Bushnell et al. ..... 340/542
7,275,641 B1 * 10/2007 Purnell ..... 206/373
7,753,228 B2 * 7/2010 Yuhara ..... 220/835
8,020,416 B2 * 9/2011 Talmage et al. ..... 70/85

(Continued)

*Primary Examiner* — Lloyd Gall
(74) *Attorney, Agent, or Firm* — Edward L. White

(57) ABSTRACT

A rapid-access weapon safe comprising a lock box having a bottom, three sides, and a lower front panel defining an opening adapted to receive a user's hand into a chamber and at least one weapon; a weapon support in the chamber for supporting the weapon's position where a user's hand easily grasp the weapon and for protecting a weapon stored in the chamber; quick-access doors having at least two doors sealing the opening, a lock securing the doors, and a spring adapted to rapidly open the doors when the lock is opened; and a mounting bracket adapted to affix the safe onto a desired location; whereby, the safe can be mounted in a desired location, the safe doors quickly deploy when the user opens the safe, allowing an authorized user quick access to the weapon inside while preventing unauthorized access when the safe is closed and locked.

12 Claims, 11 Drawing Sheets

(56) References Cited

U.S. PATENT DOCUMENTS

| | | | | |
|---|---|---|---|---|
| 8,074,477 | B1 * | 12/2011 | Weiche | 70/14 |
| 8,186,188 | B1 * | 5/2012 | Brown | 70/63 |
| 2003/0140663 | A1 * | 7/2003 | Carson | 70/63 |
| 2004/0178116 | A1 * | 9/2004 | Daetweiler et al. | 206/747 |
| 2005/0194872 | A1 * | 9/2005 | Cleveland et al. | 312/290 |
| 2007/0200471 | A1 * | 8/2007 | Boone | 312/211 |
| 2011/0247950 | A1 * | 10/2011 | McGee | 206/317 |
| 2012/0240830 | A1 * | 9/2012 | Heim et al. | 109/73 |

* cited by examiner

RAPID-ACCESS WEAPON SAFE

CROSS-REFERENCE TO RELATED APPLICATIONS

None.

FIELD OF THE INVENTION

The invention relates to a weapon safe for securely storing a weapon and mounting in a desired location for rapid access by an authorized user. The invention adds additionally safety to the user by preventing unauthorized access to the weapon

SUMMARY OF THE INVENTION

The invention relates to safely and securely storing a weapon preventing unauthorized access by other persons or children while providing rapid access to an authorized user. There is substantial interest to millions of weapons owners to not only safely and securely store their weapons, but to also make them readily accessible and in the case of a firearm to have them loaded and ready in the event of an intruder, especially at night. The safe storage of weapons in a home, vehicle, or workplace has been longstanding problem. The use of built-in safes or large gun storage cabinets, which are capable of holding several weapons, is common but usually too bulky or too expensive for the typical owner of a single weapon. Unfortunately, such storage methods are so unwieldy that they are difficult to store and when so stored do not serve as a readily accessible storage device for an authorized user. They typically cannot be stored in vehicles due to their size nor can they be stored in a home without being visible or inaccessible and as such defeats their purpose, at least in part. The result is that far too many weapons are stored openly without any protection and with easy access to unauthorized users and children. As an example, weapons are stored in furniture drawers well within the reach of children.

Additionally existing gun safes and cabinet exist but require a complicated manipulation of a mechanism to safely gain access to a gun. Some of these devices could easily confuse a responsible user attempting to open the box especially when the user is under duress from the situation.

Also, many states have passed open carry and conceal carry laws and in states where a business can prevent a user from carrying a weapon in their place of business this directly affects a user carrying weapons in a vehicle or on their person. The user needs a safe and secure place to store their weapon in their vehicle while conducting business. Safes for motor vehicles have long been desired and proposed. But due the weapons laws they have become a necessity for weapons owners. Moreover, vehicles have evolved from their original designs, which were often quite spacious with straight lines to relatively compact and curvy designs. Due to the compactness and the curvy design of modern vehicles, this has created certain obstacles to what would otherwise be an uncomplicated exercise in design and installation of safes. Because of these design complications the safes must be small and must be custom designed and fitted to a particular vehicle design. Custom designed and fitted safes present logistics problem for manufacturing. A manufacturer of these safes would be need to design and build safes for many makes, models and years of vehicles, which would be necessary to offer consumers a product for the many vehicles which consumers may own.

We have recognized that there is a real need for an improved access weapon safe that prevents access by unauthorized persons and may be readily mounted in a home, vehicle, or at the workplace, We also recognize that such a weapon safe should be readily accessible to one authorized user and allow easy removal of the weapons from a predictable and easily grasped location in the weapon safe.

The present invention is embodied in an improved access weapons safe that can safely and securely store a multitude of weapon types varying in size and shape including a loaded firearm in a variety of sizes, pepper spray, a knife, a stun gun, and a TASER® yet make it rapidly accessible when needed especially in the dark of the night. The invention simplifies the access by adding an additional spring loaded door cooperatively connected with the first door and rapidly opening when unlocked thereby increasing the speed by, which a user may obtain a weapon for self-protection, and limiting the possibility of mechanical failures and providing continued access if a failure should occur.

Additionally, the present invention is universally mountable. The safe has fasteners and brackets which allow it to be mounted to any number of surfaces such as a wall in the closet, on a door, in a desk drawer, inside a vehicle, on a bed frame are but a few examples but not limited to. In the case of mounting the safe to the bedframe, this makes the safe literally inches away and seconds from use for anyone sleeping in the bed. The person in bed need only reach over and unlock the safe which causes the safe doors to rapidly open and separate due to the spring action exposing a consistently oriented weapon ready for use.

In general, prior art weapons safes failed to provide many of the advantages and features of the present invention. Prior art weapons safes suffer from a dichotomy of preventing unauthorized access especially by children and allowing rapid access by an authorized user. The prior art has several limitations, complexity in the locking mechanism and overall safe design and space requirements to open the safes sufficiently to access the weapon. Additionally, another disadvantage if the weapon is a firearm is obstructing the barrel to maintain the correct orientation, which could have catastrophic effects with an inadvertent discharge.

This set of patents suffers from complexity issues where the user has to perform several steps in order to gain access to the weapon and any mechanical malfunction would prevent access to the weapon. U.S. Pat. No. 5,111,755 to Rouse teaches a lockable container for a loaded handgun, access to the handgun is created by a panel or a drawer both of which are slidable and the container is secured with a double lock system where one lock is unlocked to allow the second lock to be accessed where unlocking the second lock provides access to the handgun. In Rouse, the container is locked for the safe storage of a loaded handgun at a residence, which is substantially childproof and not readily accessible by an individual desiring quick and quiet access to a loaded handgun. Having a double locking mechanism and sliding access to the handgun creates a complexity that may prevent a user under duress from quickly and easily accessing the handgun. U.S. Pat. No. 8,186,188 to Brown teaches a mounting module for mounting to a fixed surface with an interior space that holds a portable safe, a portable safe that retains a tray for a weapon and a door for accessing the tray, a tray containing the weapon and lock for the portable safe. This invention is designed for security and portability but not for rapid access, it is somewhat cumbersome for a user to quickly gain access. Furthermore, the complexity may prevent a user under duress from quickly and easily accessing the handgun. U.S. Pat. Pub. No. 2012/0,240,830 to Heim teaches a safe with an automatic revolving door, a door rotatably connected to the body by a pivot where the door is substantially contained within the enclosure of the body when opened, the pivot point being approximately central to the rotation of the door, wherein the grip of the handgun is exposed when the lock is unlocked allowing the door to automatically rotate exposing the handgun. The safe maybe mounted to a fixed surface or to a larger heavier object to improve security. In Heim, the user cannot gain any access unless the door is almost totally open and any malfunction would preclude use of the weapon.

Another set of patents refers to the space requirements to open the safes sufficiently to access the weapon inside. U.S. Pat. No. 5,009,088 to Cislo teaches modular lock box and carrying case for a handgun, where a handgun is locked within a lock box while the lock box is locked to a stationary object using a clip. By disconnecting the lock box from the clip the lock box becomes a carrying case. The lock box is formed by hinging a pair of housings together to form a chamber capable of holding a handgun. The second housing is securely attached to a stationary object while the other housing of the lock box retains the handgun so that the weight of the handgun, a gas hinge, or a tension spring cause the two housings to separate with the first housing swinging open when the lock box is unlocked. Cislo uses a single housing for access to the weapon, which must have sufficient spacing around the housing for user to put their hand inside to grasp and retrieve the weapon for use. U.S. Pat. No. 6,405,861 to Siler teaches a lockable box for housing a handgun with a rigid mounting base extended forward, a door that is pivotably attached at the bottom end to the box, a lock attached to the door, and a handgun holster mounted to the door. The door drops down automatically by way of gravity when unlocked and opened where the handgun is easily and safely accessed. Adjustment can be made to the holster mount to accommodate different handgun sizes. Siler uses a single door for access to the weapon, which must have sufficient spacing around the housing for user to put their hand inside to grasp and retrieve the weapon for use. U.S. Pat. No. 8,020,416 to Talmage teaches a safe attachable to a motor vehicle with a storage space and a lockable door or a lockable slide out drawer that fits within the safe, and a mounting flange for securing the safe to the vehicle. Talmage is designed with security at the forefront thus providing few mounting options for rapid access to a weapon, which would be needed during a car jacking Tamalage uses a drawer or single door for access to the weapon, which must have sufficient spacing for a user to put their hand inside to grasp and retrieve the weapon for use.

The last set of prior art obstructs the barrel to maintain the correct orientation. U.S. Pat. No. 5,168,994 to Beletsky teaches a rectangular housing with a hinged cover with a handgun storage space with the opening large enough to allow the user to place their hand inside to grasp the handgun by its grip and to remove the handgun from the housing. The container is locked but the handgun is readily accessible from the end of the container with the grip of the handgun near the opening. Contained within the housing is a pair of adjustable holding fixtures, one engaging the barrel of the handgun and the other the trigger guard. The handgun is positioned in a known fixed position by these fixtures as well as support the handgun based on the orientation of the housing.

U.S. Pat. No. 6,570,501 to Bushnell teaches a fully enclosed hand gun case body, a biometric lock, a single door hinged at the bottom edge of the case, and a sliding mechanism with a barrel dowel which orients the grip of the handgun to the opening for easy access and holds the handgun by engaging the barrel. When the door is opened, the slide automatically moves through the opening to project the handgun for use. This invention relies on a hinged door to cooperatively operate with the sliding mechanism to provide complete access to the handgun, this complexity may prevent a user under duress from quickly and easily accessing the handgun if either mechanism fails.

U.S. Pat. No. 8,074,477 to Weiche teaches a support arm that is placed between the mattress and box springs, a back panel attached to the support arm and affixed to a bottom plate, a bottom plate with a retention finger inserted in the barrel for holding and orienting a handgun, a lockable housing pivotably affixed to the base by spring loaded hinges. When the lock is unlocked, the housing opens by spring loaded hinges revealing the handgun ready for use.

The prior attempts to develop a weapons safe that allows easy access by authorized adults yet prevents unauthorized or accidental access, especially by children, have not been completely satisfactory. Additionally, the safe needs to be universally applicable to a multitude of environments. The need for a safe with faster and easier access to a weapon in emergency situations while maintaining security more effective than those presently available is apparent. Thus, it may be seen that these known patents are very limited in their teaching and utilization, and an improved weapon storage device is needed to overcome these limitations.

The present invention overcomes these limitations in the prior art by providing a simple design that naturally orients the weapon for quick employment and in the case of a handgun without obstructing the barrel. This simple two door design with its cooperative spring loaded doors allows rapid access when opened and is still accessible in the case of malfunctioning doors. Moreover, this design requires less space to open because the two doors are 90 degrees disposed thus reducing the space required as compared to a single door design. Also, the unique case design allows mounting to a bed, a wall, in a desk or on a countertop, and in a vehicle such as a car, truck, boat or recreational vehicle (RV). The present invention solves the problems identified above by offering a weapon safe that is safe and secure from unauthorized access without sacrificing rapid and unobstructed accessibility when the need arises.

There have thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. Additional benefits and advantages of the present invention will become apparent in those skilled in the art to which the present invention relates from the subsequent description of the preferred embodiment and the appended claims, taken in conjunction with the accompanying drawings. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

DETAILED DESCRIPTION OF THE INVENTION

Figure 1:
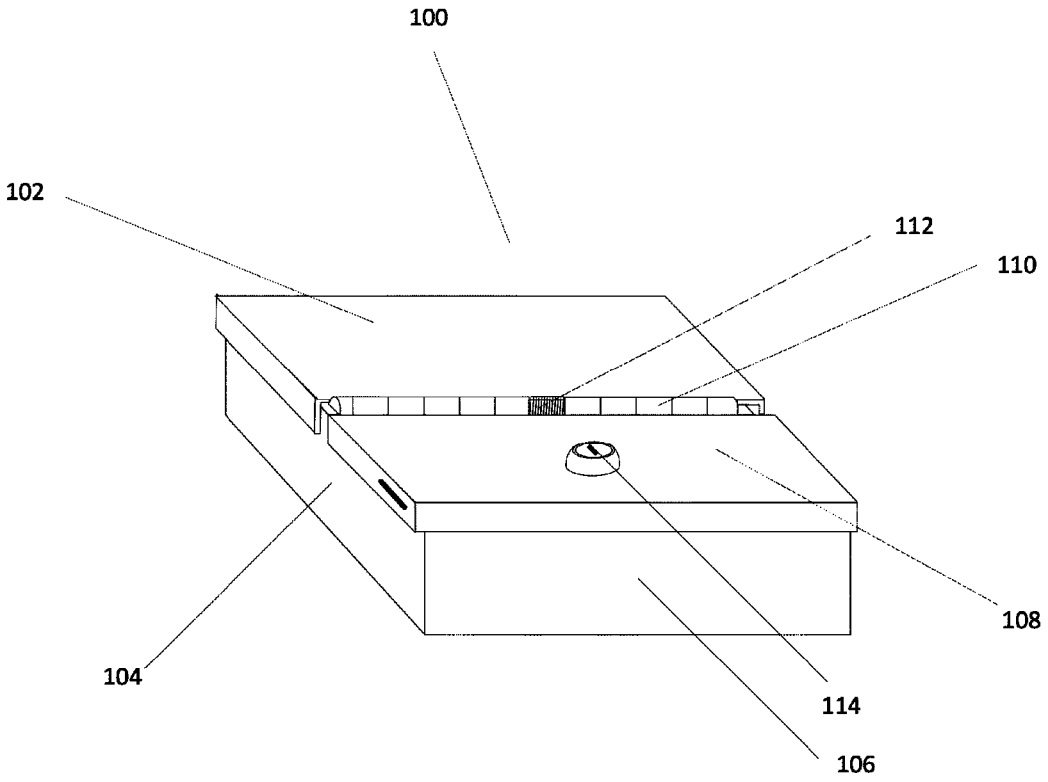
FIG. 1 is a perspective view of the weapons safe with the doors closed.

FIG. 1 shows the closed weapons safe lying flat. This rapid access weapon safe as depicted in FIG. 1, preferably comprises a lock box 100, a safe liner 602, a front door 108, a top door 106, and a mounting bracket tailored to affix the lock box 100 to a desired location. The lock box 100 has a lower front panel 102, a left side panel 104, a right side panel 400, a back panel 300, and a bottom panel 500. These sides brought together with the lower front panel 102 and the bottom panel 500, define a chamber 604 wherein a weapon is positioned and stored and the weapon may be a firearm 702 or another type of weapon, such as a knife, stun gun, pepper spray and TASER®. The lock box 100 may be fabricated from a single piece of material or individual panels could be fabricated and welded together creating the chamber. Other methods of joining the panels including, but not limited to, other methods of joining the panels will be apparent to one skilled in the art.

There are preferably two quick access spring-loaded doors attached to the lock box 100. The first door is a front door 108, and the second door is a top door 106 that will be described later. The front door 108 is affixed to the bottom front panel 102 by a spring loaded front hinge 110. The front door spring 112 enables the front door 108 to quickly open upon unlocking the lock 114 thereby allowing a user to quickly gain access to the weapons stored inside the chamber. The front door spring 112 must be sufficiently strong to open the front door 108 rapidly for quick access.

Figure 2:
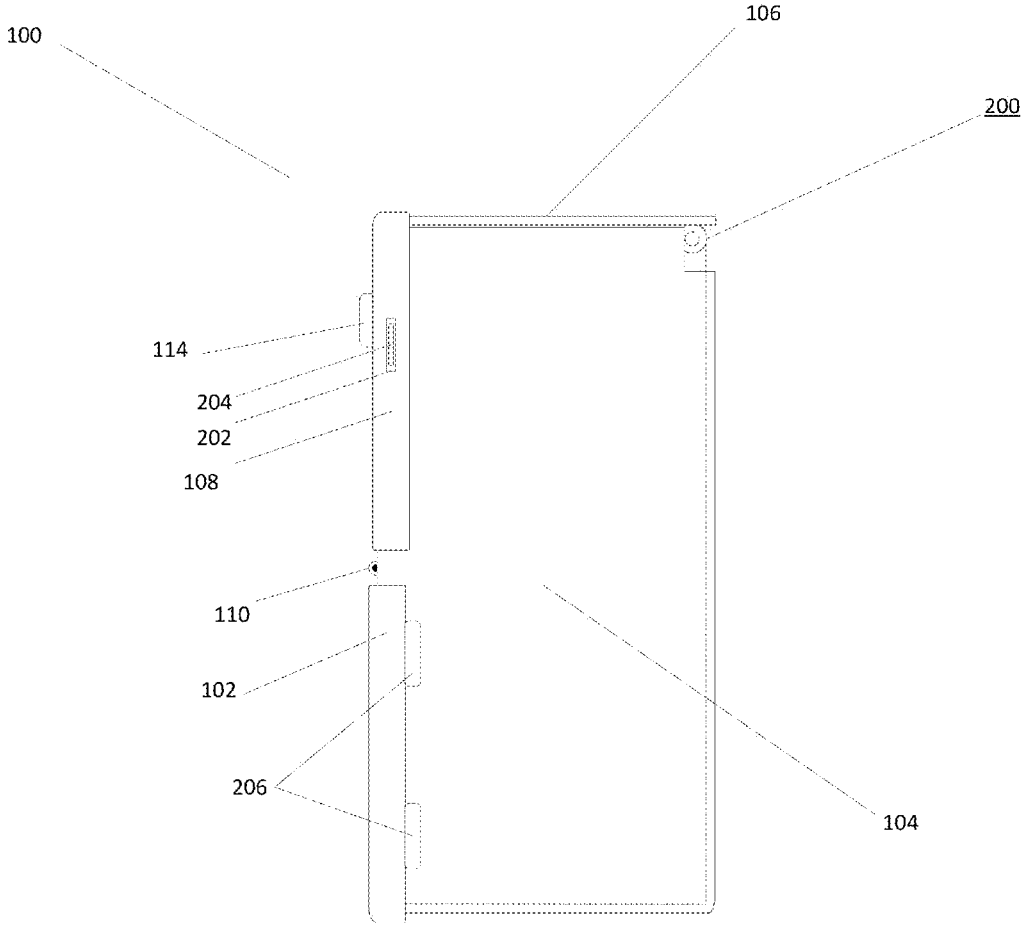
FIG. 2 is a side view of the left side of the weapons safe with the doors closed.

FIG. 2 depicts the lock box 100 viewed from the left side wherein a top hinge 200 is displayed. The top hinge 200 affixes the back panel 300 to the top door 106. The front door 108 works in cooperation with the top door 106 whereas the front door 108 captures the top door 106 and secures it in place when the doors are in a closed and locked position. Once the lock 114 has been unlocked, the front door 108 will immediately spring open releasing the top door 106, which will immediately spring up allowing a user access to the weapon inside.

The lock 114 consists of four elements, locking arms 204, door slots 202, panel slots 600 and locking arm guides 700 depicted later in FIG. 7. A key is inserted into the lock 114 and rotated to lock and unlock the lock box 100. When locking the lock box 100, the locking arms 204 (also referred to as securing points) extend from the central lock 114 and protrude through the locking arm guides 700 which guide them through the panel slots 600 where they engage the left side panel 104 and right side panel 400. These locking arms 204 further extend through the door slots 202 and engage the front door 108. The lock 114 and the locking arms 204 are later depicted in FIG. 7. The locked position prevents unauthorized users, especially children, from gaining access to the weapons inside. Unlocking the lock box 100, the lock 114 retracts the locking arms 204 when rotated disengaging both the door slots 202 and the panel slots 600 but still engaging the locking arm guides 700. The key operated lock 114 may be replaced with other types of locks for securing the lock box 100 such as an eyes free keypad lock, combination lock, electronic lock, biometric lock, and wireless lock, but not limited to, other locks for securing the lock box 100 will be apparent to one skilled in the art.

FIG. 2 further illustrates the preferred joining method of spot welding as illustrated by two of the six front panel welds 206. The lower front panel 102 may be welded to the lock box 100 with a single continuous weld, which is more costly and time consuming. Other methods of joining the panels including, but not limited to, other methods of joining the panels will be apparent to one skilled in the art.

Figure 3:
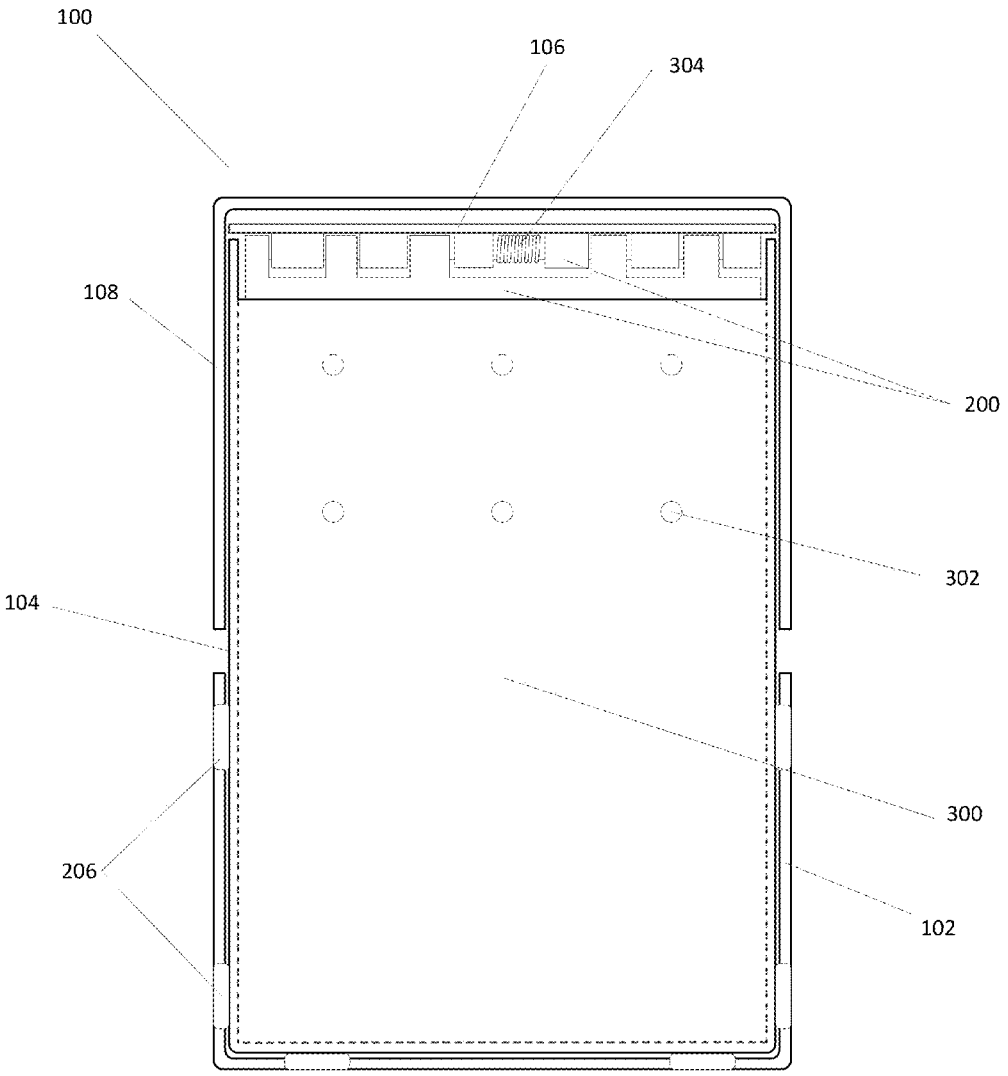
FIG. 3 is a rear view of the weapons safe with the doors closed.

FIG. 3 is a rear view of the weapon safe with the doors in the locked position. FIG. 3 depicts a back panel 300 with mounting holes 302 wherein these mounting holes 302 may be used to mount the lock box 100 to a mounting bracket or may be used to directly mount the lock box 100 to a fixed object for quick access.

Further illustrated in FIG. 3, the top hinge 200 connects the top door 106 and the back panel 300, which can be more clearly seen, than in the preceding figure. Also attached to the top hinge 200 is a top door spring 304, which allows the top door 106 to rapidly open upon the lock 114 being unlocked and allowing a user to quickly gain access to the weapon inside. The top door spring 304 must be sufficiently strong to open the top door 106 rapidly for quick access.

Figure 4:
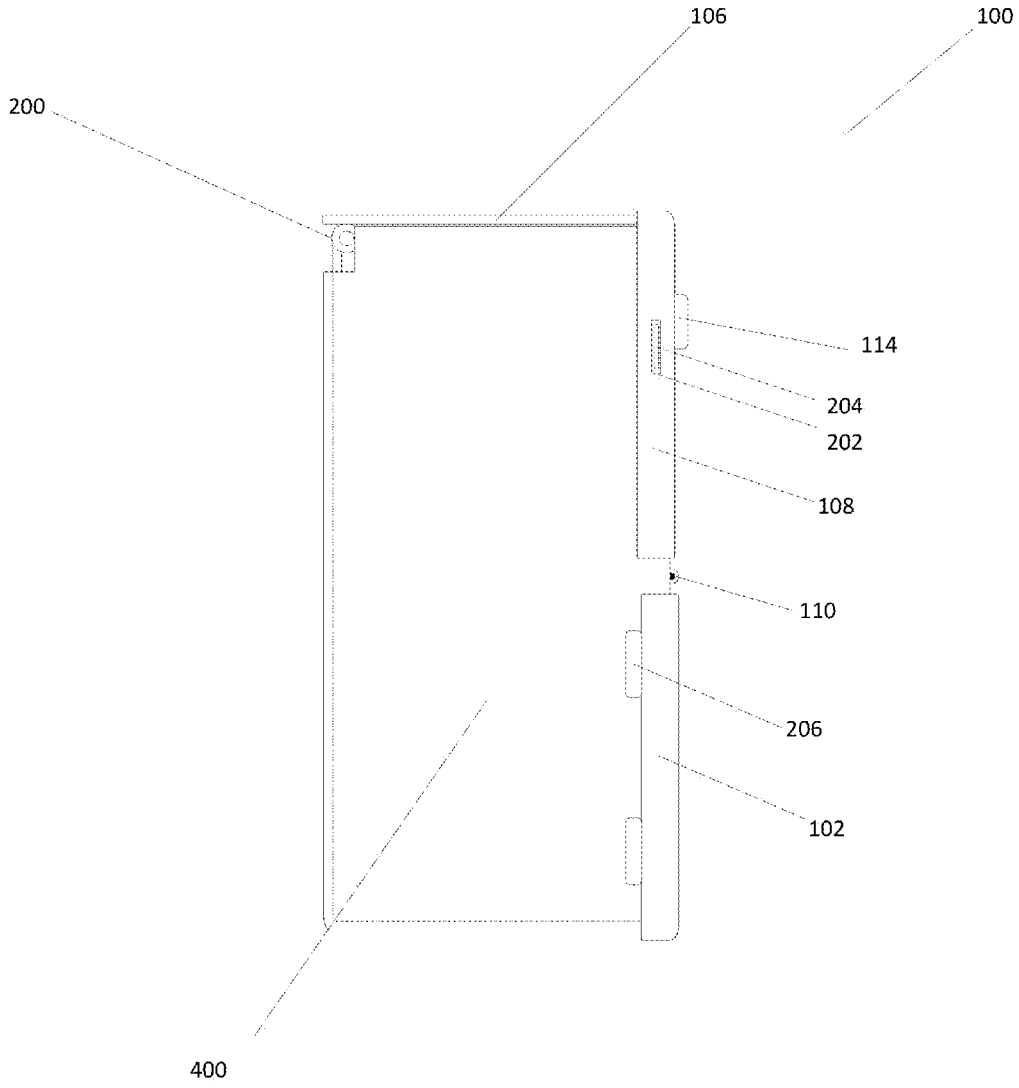
FIG. 4 is a side view of the right side of the weapons safe with the doors closed.

FIG. 4 is a side view of the right side of the weapon safe with the doors closed. The right side panel 400 is identical to the left side panel 104 of the lock box 100 having a panel slot 600 and two front panel welds 206.

Figure 5:
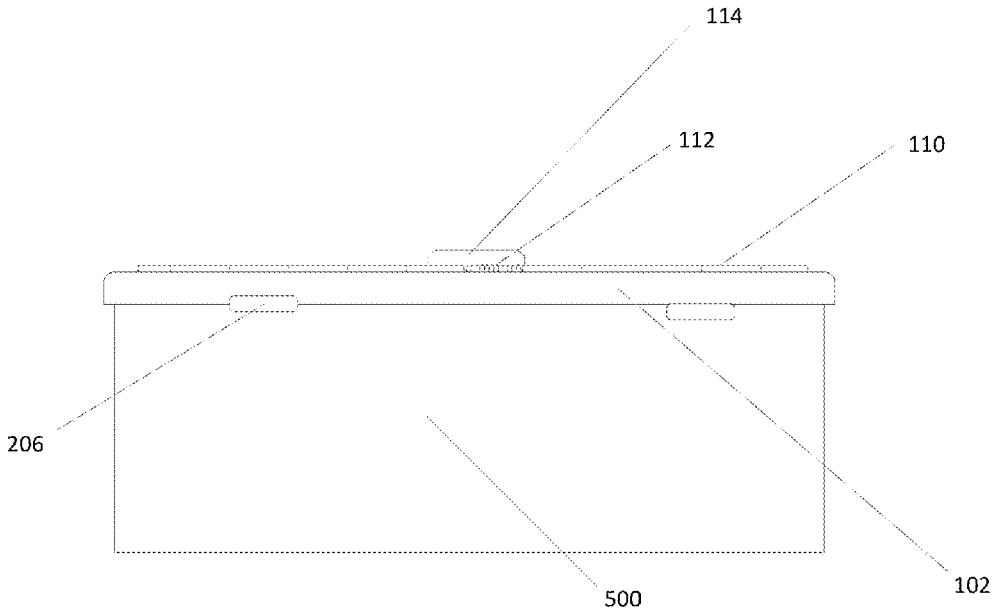
FIG. 5 is a bottom view of the weapons safe with the doors closed.

FIG. 5 is a bottom view of the weapon safe with the doors closed. FIG. 5 illustrates the bottom of the lock box 100 showing the bottom panel 500 and two front panel welds 206 connecting the bottom panel 500 to the lower front panel 102.

Figure 6:
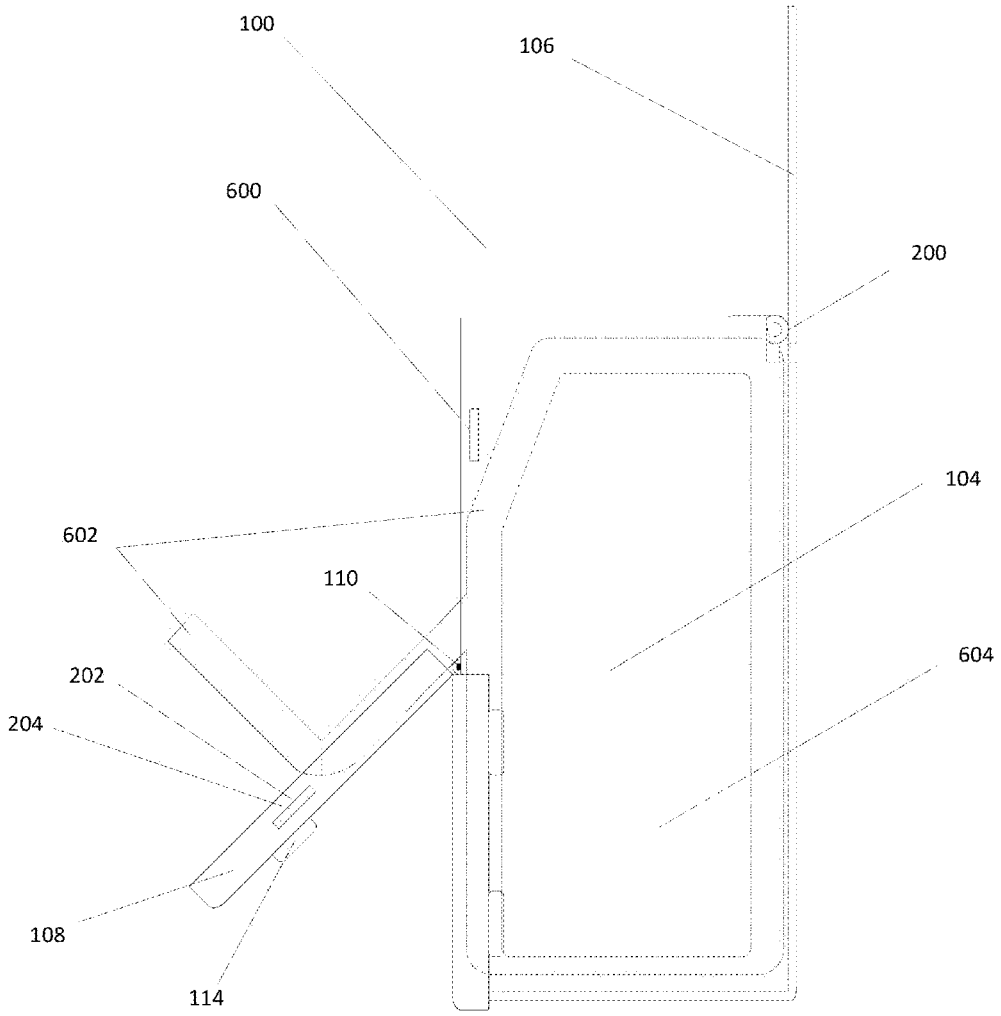
FIG. 6 is a side view of the left side of the weapons safe with the doors open.

FIG. 6 is a side view of the left side of the lock box 100 with the front door 108 and top door 106 open for a user to rapidly access a weapon. Also depicted in FIG. 6 is the panel slots 600 located on the left side panel 104 and the right side panel 400 where the locking arms 204 extend through the left side panel 104 and the right side panel 400 and engage the two door slots 202 located on the front door 108 preventing the door from being opened by an unauthorized user.

Additionally, FIG. 6 depicts a safe liner 602 installed in the chamber 604 that protects the firearm 702 and extra magazine 704 while they are secured inside the lock box 100. The firearm 702 and extra magazine 704 are surrounded on all sides by this liner protecting them from any damage that may occur and it also positions the firearm 702 and extra magazine 704 for rapid access by the user. The front section of the safe liner 602 adjacent to the front door 108 is fabrically hinged and attached to the front door 108 by VELCRO®. Other methods of securing the safe liner 602 to the front door 108 including, but not limited to, other methods of attaching the safer liner 602 to the front door 108 will be apparent to one skilled in the art. When the lock 114 is unlocked and the doors spring open, the safe liner 602 attached to the front door 108 opens with the front door 108 revealing the firearm 702 and extra magazine 704. Upon closing the doors, the safe liner 602 surrounds the firearm 702 and extra magazine 704 on all sides. The safe liner 602 may be constructed from a resilient soft material that conforms to the shape on the weapon. Other materials for protecting and positioning the weapon including, but not limited to, other materials for protecting and positioning the weapon will be apparent to one skilled in the art.

Figure 7:
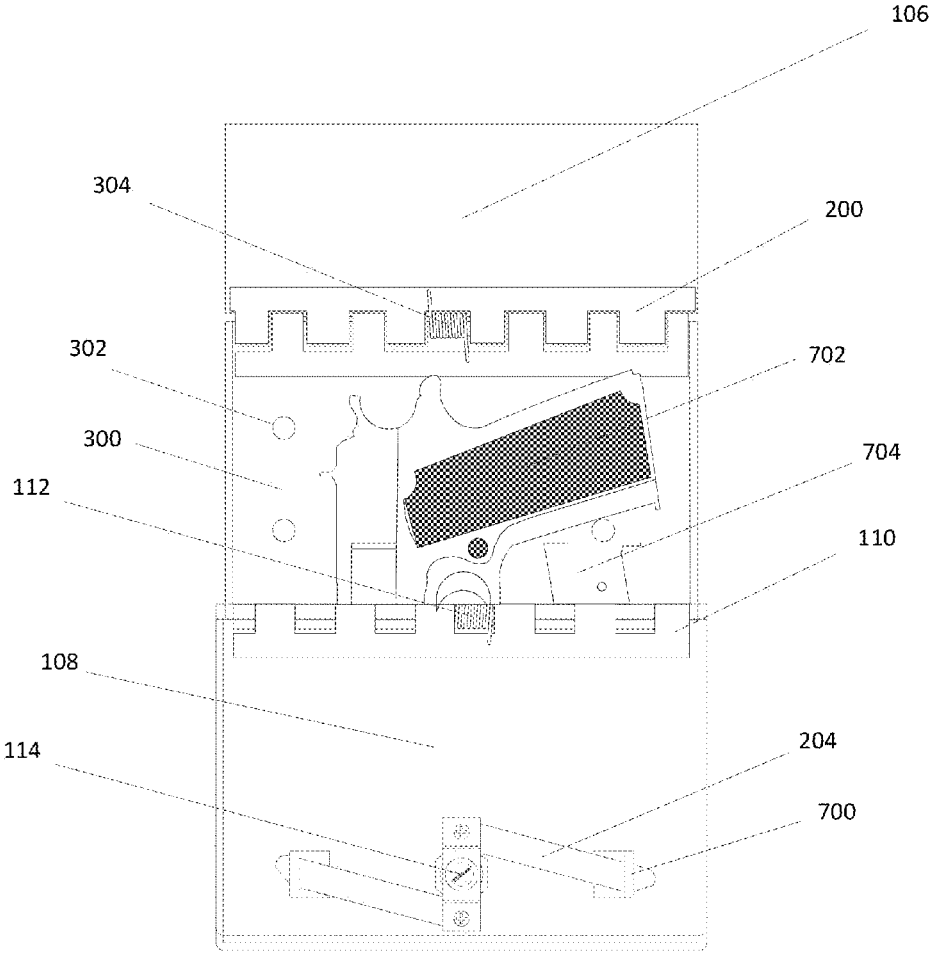
FIG. 7 is a front view of the weapons safe with the doors open and a firearm and extra magazine positioned inside.

FIG. 7 is the front view of the lock box 100 with the front door 108 and top door 106 open and a firearm 702 and an extra magazine 704 positioned inside. The chamber 604 inside the lock box 100 along with the safe liner 602 orients the barrel of the firearm 702 toward the bottom panel 500, which if installed in the current depicted position to a fixed object, orients the barrel of the firearm 702 toward the ground providing an added safety measure. The size and style of the firearm 702 will determine the size of a lock box 100 required. It may be desirable for the chamber to be sized to accommodate at least one extra ammunition source for a firearm. The lock box 100 is depicted with a firearm 702 the most likely weapon of choice, but the lock box is not limited to this type of weapon. A TASER®, pepper spray or other object used for self-defense may be secured in this lock box 100 for rapid access and will be sized appropriately to fit the type of weapon desired by the user.

Additionally, FIG. 7 illustrates the lock 114, locking arms 204, and the locking arm guides 700. When the lock 114 is in the unlocked position, the locking arms 204 are retracted and disengaged from the door slots 202 and panel slots 600 while still engaging the locking arm guides 700. When the lock 114 is moved from the unlocked position to the locked position, the lock 114 is rotated extending the locking arms 204 through the locking arm guides 700, the panel slots 600 and the door slots 202 securing the lock box 100.

Figure 8:
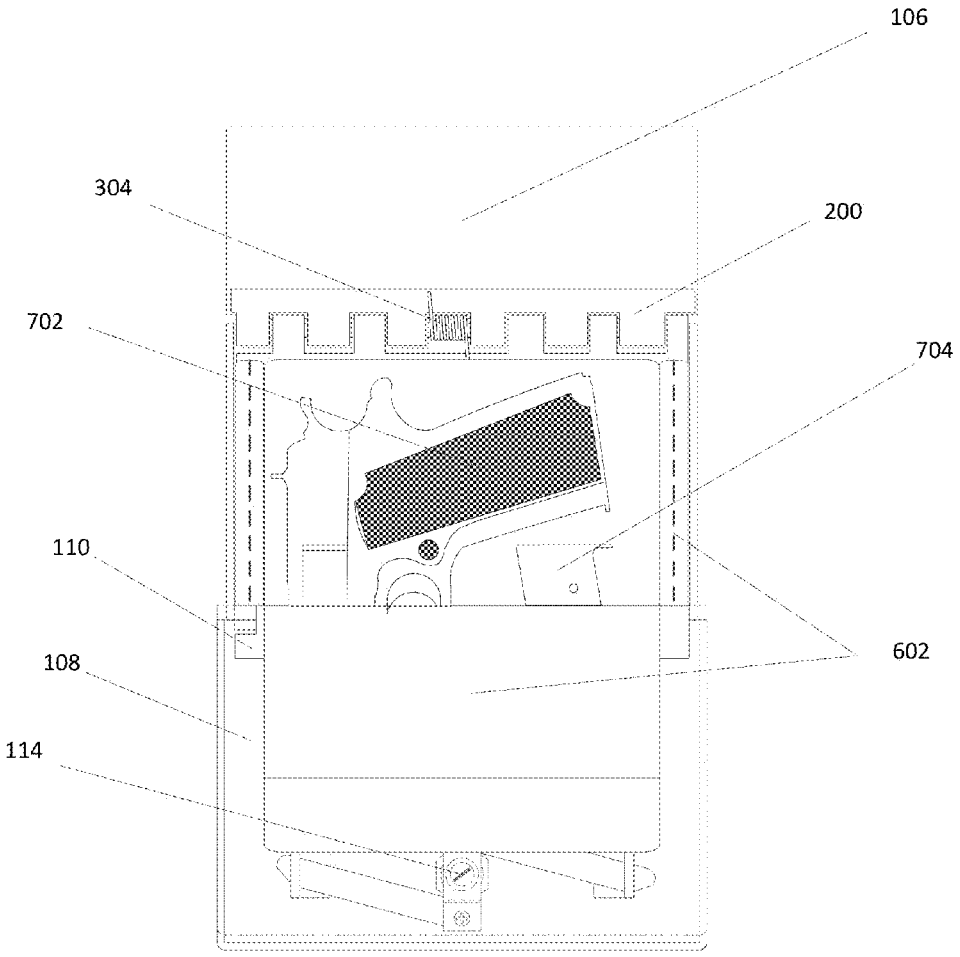
FIG. 8 is a front view of the weapons safe with the doors open, a safe liner installed with a firearm and extra magazine positioned inside the safe.

FIG. 8 is a front view of the lock box 100 with the doors open with the safe liner 602 installed and attached to the front door 108 and a firearm 702 and an extra magazine 704 inserted into the safe liner 602 and the chamber 604. This view illustrates the operational position once the lock 114 has been unlocked. As depicted and as previously described in FIG. 6, the safe liner 602 is attached to the sides of the lock box 100 and the front of the safe liner 602 is attached to the front door 108 which opens the safe liner 602 upon unlocking the lock box 100 allowing a user to rapidly retrieve the firearm 702 and the extra magazine 704. Additionally, the safer liner 602 attached to the front door 108 is sized such that it will not interfere with the lock 114.

Figure 9:
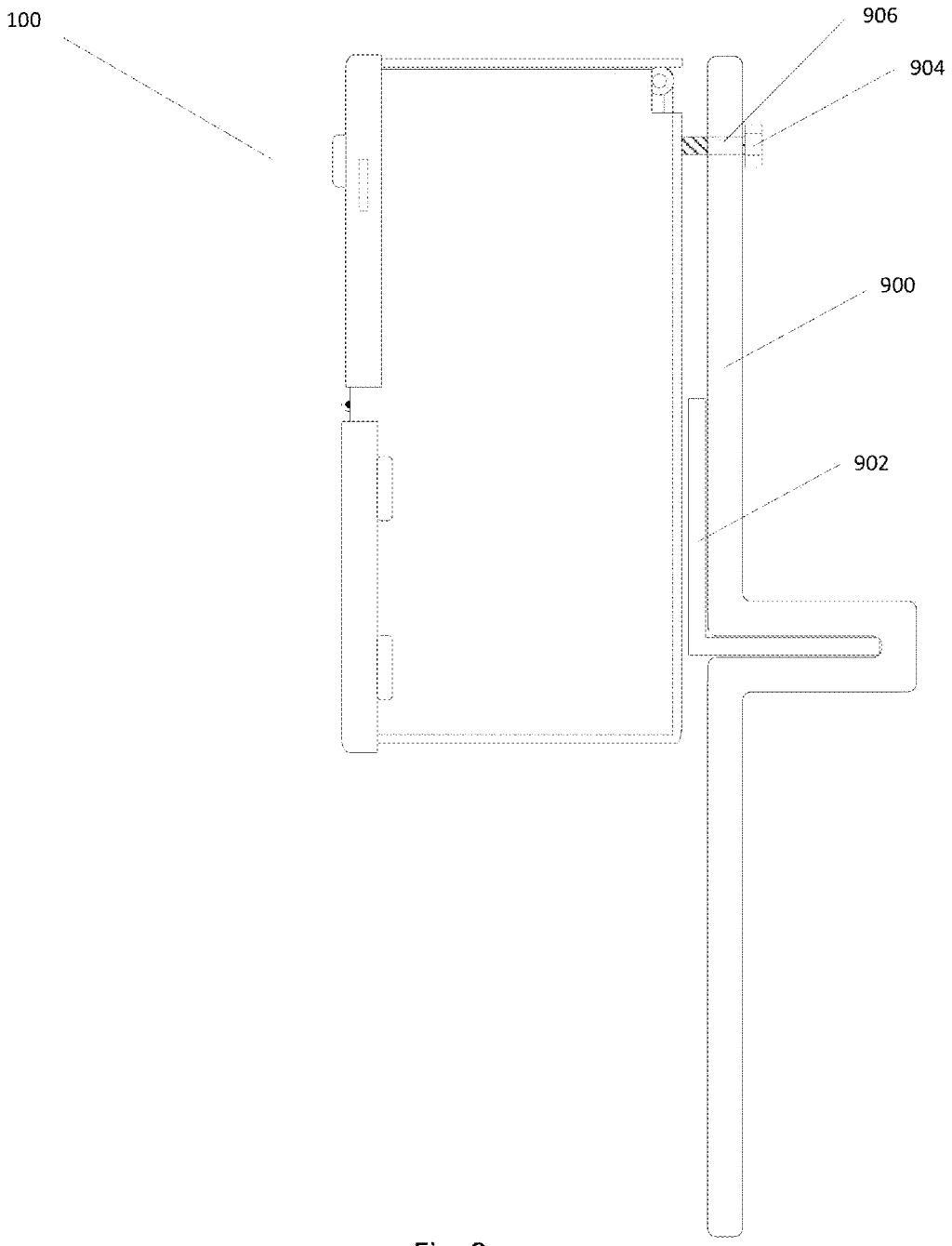
FIG. 9 is a side view of the left side of the weapons safe mounted to a "L" style bed frame using a mounting bracket specifically designed for this type of bed frame.

The next several figures illustrate methods in which the lock box 100 may be mounted. First, FIG. 9 depicts a side view of the left side of the lock box 100 mounted to an L-style bed frame 902 using mounting bracket 900 specifically designed for this type of bed frame. The L-style bed frame 902 is inserted into the mounting bracket 900 and the lock box 100 is attached to the mounting bracket 900 with fasteners 904 that extend through the lock box mounting holes 906 in the L-shaped mounting bracket 900 into the lock box 100 thereby enclosing the L-style bed frame 902. The fasteners 904 should be selected such that they prevent the lock box 100 from being easily removed.

Figure 10:
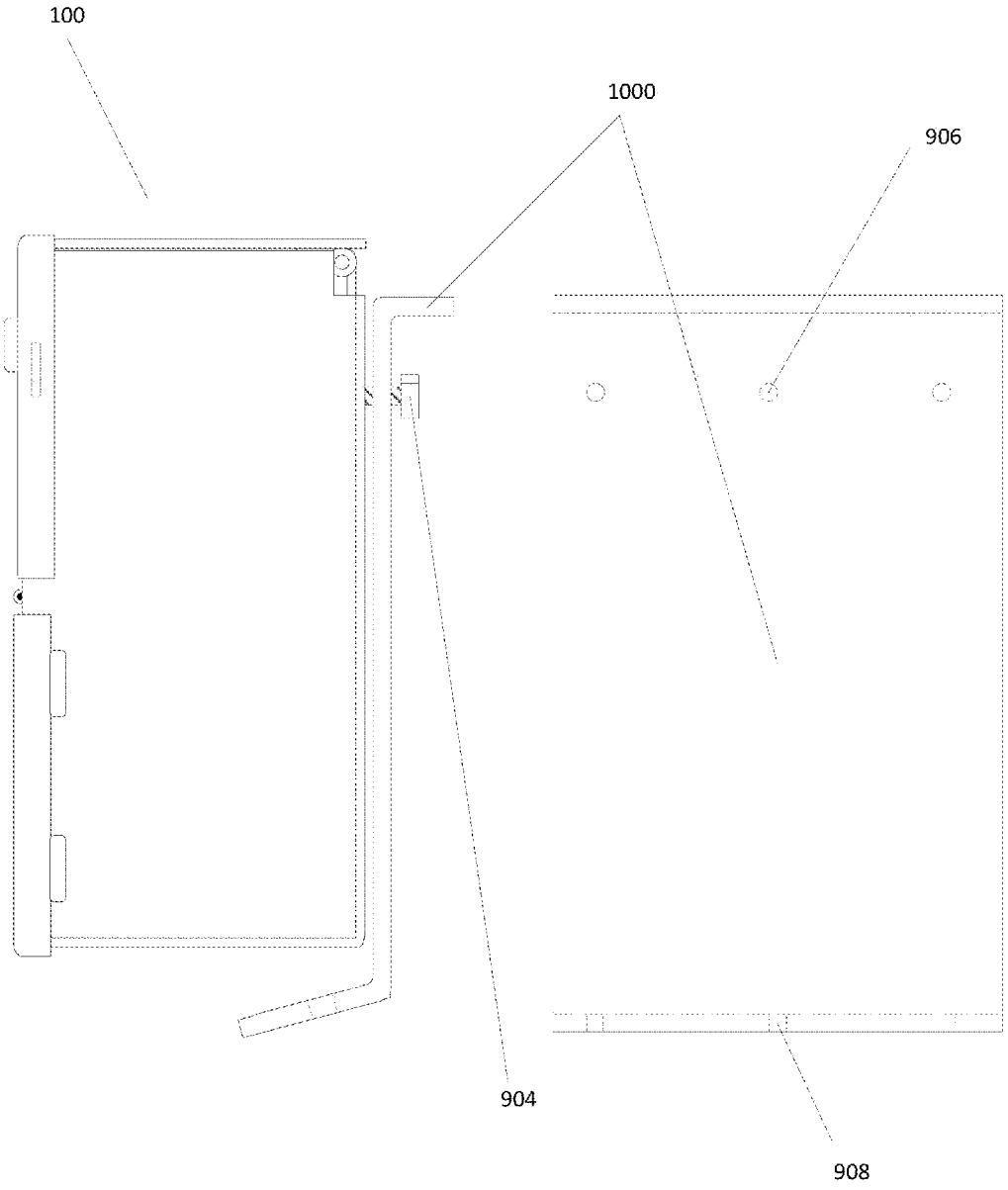
FIG. 10 is a side view of the left side of the weapons safe mounting bracket for use with horizontal surfaces.

FIG. 10 depicts a side view of the left side of a flat surface mounting bracket 1000 for mounting the lock box 100 to horizontal surfaces. The lock box 100 is secured to the flat surface mounting bracket 1000 in the same manner as previously described above and is attached to the fixed horizontal surface with the appropriate fastener based on the type of surface.

Figure 11:
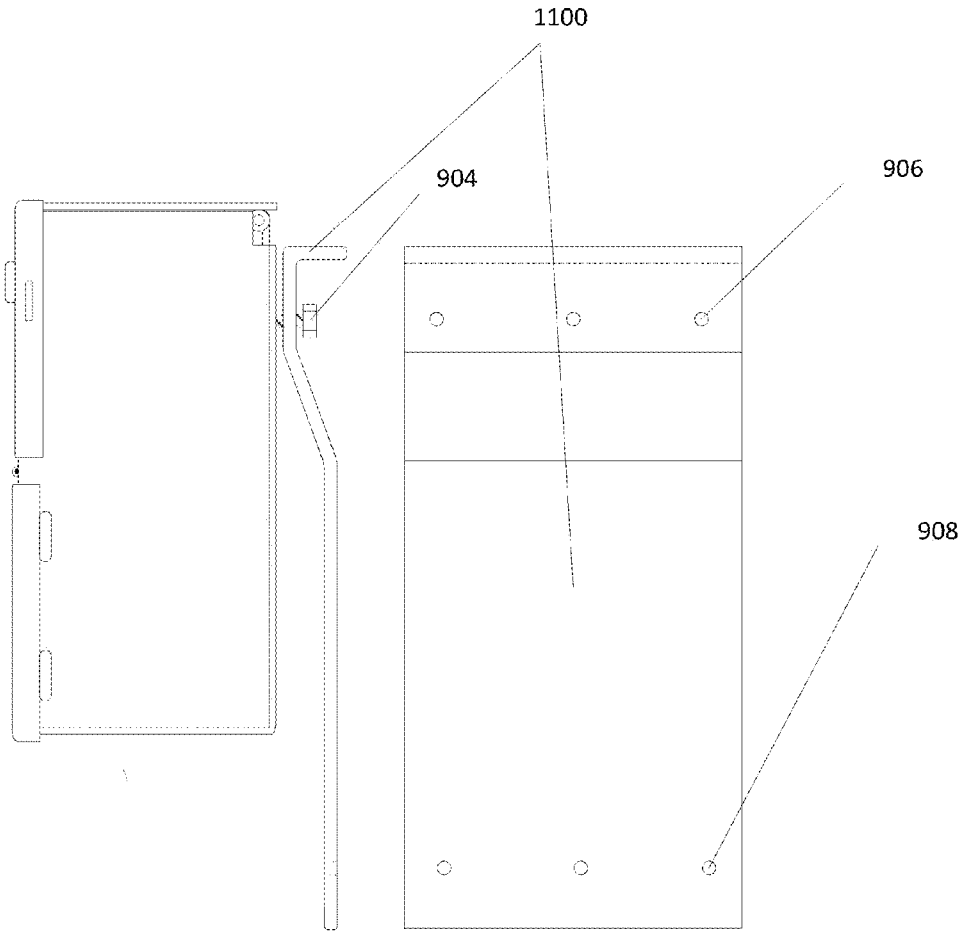
FIG. 11 is a side view of the left side of the weapons safe mounting bracket for use with vertical surfaces.

FIG. 11 depicts a side view of the left side of the vertical surface mounting bracket 1100 for mounting the lock box 100 to vertical surfaces. The lock box 100 is secured to the vertical surface mounting bracket 1100 in the same manner as previously described above and is attached to the fixed vertical surface with the appropriate fastener based on the type of surface. Other methods of attaching the lock box 100 to a fixed surface including, but not limited to, other methods of attaching the lock box 100 will be apparent to one skilled in the art.

The purpose of the abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application which is measured by the claims, nor is it intended to be limiting as to the scope of the invention in any way.

While the invention has been shown, illustrated, described and disclosed in terms of specific embodiments or modifications, the scope of the invention should not be deemed to be limited by the precise embodiments or modifications therein shown, illustrated, described or disclosed. Such other embodiments or modifications are intended to be reserved especially as they fall within the scope of the claims herein appended.

Having thus described the invention, I claim:

1. A rapid-access weapon safe comprising:

a. a lock box having—
   i a bottom panel,
   ii three sides, and
   iii a lower front panel defining an opening adapted to receive a user's hand into a chamber adapted to receive at least one weapon;

b. a weapon positioning means in the chamber for positioning the weapon in an orientation where a user's hand easily grasps the weapon and for protecting a weapon stored in the chamber;

c. quick-access doors having—
   i at least two doors covering the opening,
   ii a lock with a plurality of securing points, securing the doors, and
   iii an opening means adapted to rapidly open the doors when the lock is opened;

d. a mounting means adapted to affix the safe onto a desired location; and e. a weapon stored in the chamber, whereby the safe can be mounted in a desired location, the safe doors quickly deploy when the user opens the safe, allowing an authorized user quick access to the weapon inside while preventing unauthorized access when the safe is closed and locked.

2. The safe of claim 1, where the weapon is selected from a group consisting of a firearm, a knife, pepper spray, stun gun, and TASER®.

3. The safe of claim 1, where the positioning means is a resilient soft material that protects and positions the weapon for ready access.

4. The safe of claim 1, the opening means is adapted to rapidly deploy the doors from a closed position to an open position.

5. The safe of claim 1, where the lock is selected from a key lock, eyes free keypad lock, combination lock, electronic lock, biometric lock, and wireless lock.

6. The safe of claim 1, where the mounting means has a predetermined shape and size to affix to a desired location.

7. A rapid-access weapon safe comprising:

a. a lock box having— i a bottom panel, ii three sides, and iii a lower front panel defining an opening adapted to receive a user's hand into a chamber adapted to receive at least one weapon;

b. a weapon positioning means in the chamber for positioning the weapon in an orientation where a user's hand easily grasps the weapon and for protecting a weapon stored in the chamber;

c. quick-access doors having— i two doors covering the opening, one door adapted to prevent at least one other door from opening, ii a lock with a plurality of securing points securing at least one door, and iii an opening means adapted to rapidly open both doors and keep the doors open when the lock is opened;

d. a mounting bracket adapted to affix the safe onto a vehicle; and e. a weapon stored in the chamber, whereby the safe can be mounted in a desired location, the safe doors quickly deploy when the user opens the safe, allowing an authorized user quick access to the weapon inside while preventing unauthorized access when the safe is closed and locked.

8. The safe of claim 7, where the weapon is selected from a group consisting of a firearm, a knife, pepper spray, stun gun, and TASER®.

9. The safe of claim 7, where the weapon positioning means is a resilient soft material that protects and positions the weapon for ready access.

10. The safe of claim 7 wherein the opening means is a mechanical device adapted to rapidly deploy the doors from a closed position to an open position.

11. The safe of claim 7, where the lock is selected from a key lock, eyes free keypad lock, combination lock, electronic lock, biometric lock, and wireless lock.

12. The safe of claim 7, where the mounting bracket has a predetermined shape and size to engage a vehicle.

* * * * *